US011808169B2

(12) United States Patent
Joly et al.

(10) Patent No.: US 11,808,169 B2
(45) Date of Patent: Nov. 7, 2023

(54) ASSEMBLY FOR A TURBOMACHINE

(71) Applicant: SAFRAN AIRCRAFT ENGINES, Paris (FR)

(72) Inventors: Philippe Gérard Edmond Joly, Moissy-Cramayel (FR); Romain Nicolas Lagarde, Moissy-Cramayel (FR); Jean-Marc Claude Perrollaz, Moissy-Cramayel (FR); Laurent Jablonski, Moissy-Cramayel (FR); François Jean Comin, Moissy-Cramayel (FR); Edouard Antoine Dominique Marie De Jaeghere, Moissy-Cramayel (FR); Charles Jean-Pierre Douguet, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 58 days.

(21) Appl. No.: 17/614,667

(22) PCT Filed: May 27, 2020

(86) PCT No.: PCT/EP2020/064650
§ 371 (c)(1),
(2) Date: Nov. 29, 2021

(87) PCT Pub. No.: WO2020/239808
PCT Pub. Date: Dec. 3, 2020

(65) Prior Publication Data

US 2022/0228494 A1 Jul. 21, 2022

(30) Foreign Application Priority Data

May 29, 2019 (FR) ..... 1905734

(51) Int. Cl.
*F01D 5/26* (2006.01)
*F01D 5/16* (2006.01)
(Continued)

(52) U.S. Cl.
CPC ..... *F01D 5/26* (2013.01); *F01D 5/16* (2013.01); *F01D 5/225* (2013.01); *F04D 29/324* (2013.01);
(Continued)

(58) Field of Classification Search
CPC ..... F01D 5/16; F01D 5/10; F01D 5/22; F01D 5/26; F01D 5/06; F01D 5/225;
(Continued)

(56) References Cited

U.S. PATENT DOCUMENTS 4,494,909 A * 1/1985 Forestier ..... F01D 11/008 416/193 A
4,723,889 A * 2/1988 Charreron ..... F01D 21/045 416/193 A
(Continued)

FOREIGN PATENT DOCUMENTS

EP 1985810 B1 6/2010
FR 2585069 A1 1/1987
(Continued)

OTHER PUBLICATIONS

Yu et al., A compressible Damping, Jan. 6, 2016, CPO, CN 204941612, (Year: 2016).*
(Continued)

*Primary Examiner* — Sabbir Hasan
*Assistant Examiner* — Joshua R Beebe
(74) *Attorney, Agent, or Firm* — Sughrue Mion, PLLC

(57) ABSTRACT

The present invention relates to an assembly for a turbomachine, comprising: a first rotor; a second rotor, and a damper (2) configured to damp a displacement of the first rotor
(Continued)

relative to the second rotor, the damper comprising: a first portion (21) bearing against the first rotor and having a first thickness, a second portion (22) bearing against the second rotor and having a second radial thickness, and a third portion (23) connecting the first portion (21) to the second portion (22) and having a third radial thickness, wherein the third radial thickness is greater than at least one of the first radial thickness and the second radial thickness.

13 Claims, 5 Drawing Sheets

(51) Int. Cl.
*F01D 5/22* (2006.01)
*F04D 29/32* (2006.01)
*F04D 29/66* (2006.01)

(52) U.S. Cl.
CPC ..... *F04D 29/668* (2013.01); *F05D 2220/36* (2013.01); *F05D 2230/60* (2013.01); *F05D 2240/80* (2013.01); *F05D 2260/96* (2013.01)

(58) Field of Classification Search
CPC ..... F05D 2230/30; F05D 2230/36; F05D 2240/30; F05D 2240/80; F05D 2260/96; F05D 2220/36; F04D 29/324; F04D 29/668
See application file for complete search history.

(56) References Cited

U.S. PATENT DOCUMENTS

| | | | | |
|---|---|---|---|---|
| 5,205,713 | A * | 4/1993 | Szpunar | F01D 5/26 416/193 A |
| 5,820,346 | A * | 10/1998 | Young | F01D 5/22 416/193 A |
| 8,911,210 | B2 * | 12/2014 | Bilz | F01D 5/3053 416/193 A |
| 9,151,170 | B2 * | 10/2015 | El-Aini | F01D 5/34 |
| 2009/0123286 | A1 * | 5/2009 | Mace | F01D 5/22 416/193 A |
| 2016/0298546 | A1 | 10/2016 | Edwards | |

FOREIGN PATENT DOCUMENTS

| | | | |
|---|---|---|---|
| FR | 2923557 | B1 | 1/2010 |
| FR | 2949142 | B1 | 10/2011 |
| WO | 2016/059348 | A1 | 4/2016 |

OTHER PUBLICATIONS

Search Report dated Dec. 12, 2019 from the French Intellectual Property Office in FR Application No. 1905734.
International Search Report dated Jul. 9, 2020 from the International Searching Authority in International Application No. PCT/EP2020/064650.

* cited by examiner

ASSEMBLY FOR A TURBOMACHINE

CROSS REFERENCE TO RELATED APPLICATIONS

This application is a National Stage of International Application No. PCT/EP2020/064650 filed May 27, 2020, claiming priority based on French Patent Application No. 1905734 filed May 29, 2019, the entire contents of each of which being herein incorporated by reference in their entireties.

FIELD OF THE INVENTION

The present invention relates to an assembly for a turbomachine.

The invention relates more specifically to an assembly for a turbomachine comprising a damper.

STATE OF THE ART

A turbomachine known from the state of the art comprises a casing and a fan capable of being rotated relative to the casing, around a longitudinal axis, by means of a fan shaft. The fan comprises a disk centered on the longitudinal axis, and a plurality of blades distributed circumferentially at the outer part of the disk.

The range of operation of the fan is limited. More specifically, the evolution of a compression rate of the fan as a function of an air flow rate it draws when rotated, is restricted to a predetermined range.

Beyond this range, the fan is indeed subjected to aeroelastic phenomena which destabilize it. More specifically, the air circulating through the running fan supplies energy to the blades, and the blades respond in their eigenmodes at levels that may exceed the endurance limit of the material constituting them. This fluid-structure coupling therefore generates vibrational instabilities which accelerate the wear of the fan and reduce its service life.

A fan which comprises a reduced number of blades, and which is subjected to high aerodynamic loads, is very sensitive to this type of phenomena.

This is the reason why it is necessary to guarantee a sufficient margin between the stable operating range and the areas of instability, so as to spare the endurance limits of the fan. To do so, it is known practice to equip the fan with dampers. Examples of dampers have been described in documents FR 2 949 142, EP 1 985 810 and FR 2 923 557, in the name of the Applicant. These dampers are all configured to be housed between the platform and the root of each blade, within the housing delimited by the respective stilts of two successive blades. Furthermore, such dampers operate during a relative movement between two successive blade platforms, by dissipation of the vibration energy, for example by friction. Consequently, these dampers focus only on damping a first vibratory mode of the blades which characterizes a synchronous response of the blades to the aerodynamic loads. In this first vibratory mode, the inter-blade phase-shift is non-zero.

However, such dampers are totally ineffective for damping a second vibratory mode in which each blade flaps relative to the disk with a zero inter-blade phase-shift. Indeed, in this second vibratory mode, there is no relative movement between two successive blade platforms. This particular response of the blades to the aerodynamic loads, although asynchronous, still involves a non-zero moment on the fan shaft. In addition, this second vibratory mode is coupled between the blades, the disk and the fan shaft. The amplitude of this second vibratory mode is all the more important as the blades are large.

There is therefore a need to overcome at least one of the drawbacks of the state of the art described above.

DISCLOSURE OF THE INVENTION

One aim of the invention is to damp a mode of vibration of a rotor in which the phase-shift between the blades of said rotor is zero.

Another aim of the invention is to influence the damping of modes of vibration of a rotor in which the phase-shift between the blades of said rotor is non-zero.

Another aim of the invention is to propose a damping solution which is simple and easy to implement.

To this end, according to a first aspect of the invention, an assembly for a turbomachine is proposed, comprising:

- a casing,
- a first rotor:
  - movable in rotation relative to the casing around a longitudinal axis, and
  - comprising:
  - a disk, and
  - a plurality of blades capable of flapping relative to the disk during a rotation of the first rotor relative to the casing,
- a second rotor movable in rotation relative to the casing around the longitudinal axis, and
- a damper configured to damp a movement of the first rotor relative to the second rotor, in a plane orthogonal to the longitudinal axis, the movement being caused by a flapping of at least one blade among the plurality of blades, the damper comprising:
- a first part bearing on the first rotor, and having:
- a first radially inner surface extending all around the longitudinal axis,
- a first radially outer surface extending all around the first radially inner surface, and
- a first radial thickness measured perpendicular to the longitudinal axis between the first radially inner surface and the first radially outer surface,
- a second part bearing on the second rotor, and having:
- a second radially inner surface extending all around the longitudinal axis,
- a second radially outer surface extending all around the second radially inner surface, and
- a second radial thickness measured perpendicular to the longitudinal axis between the second radially inner surface and the second radially outer surface, and
- a third part connecting the first part to the second part, and having:
- a third radially inner surface extending all around the longitudinal axis,
- a third radially outer surface extending all around the third radially inner surface, and
- a third radial thickness measured perpendicular to the longitudinal axis between the third radially inner surface and the third radially outer surface, in which the third radial thickness is greater than at least one among the first radial thickness and the second radial thickness and the third part comprises a bulge.

It is by damping a movement of the first rotor relative to the second rotor, in a plane orthogonal to the longitudinal axis, that it is possible to influence the second vibratory mode. Actually, unlike the first vibratory mode, the second vibratory mode is characterized by a zero inter-blade phase-shift. Consequently, placing a damper between two successive blades of a rotor, as it has already been proposed in the prior art, has no effect on the second vibratory mode. The damper of the assembly described above has, for its part, the advantage of influencing the second vibratory mode because it plays on an effect of the second vibratory mode: the movement of the first rotor relative to the second rotor, in the plane orthogonal to the longitudinal axis. By opposing this effect, the damper disrupts the cause thereof that is to say dampens the second vibratory mode. It should nevertheless be noted that the first vibratory mode also participates in the movement of the first rotor relative to the second rotor, in the plane orthogonal to the longitudinal axis. Consequently, by opposing this effect, the damper also participates in disrupting another cause thereof that is say damping the first vibratory mode. In addition, since the damper is annular, it allows distributing the bearing stresses applied by the damper on the first rotor and on the second rotor, over a larger surface. From there, the damper wears less the first rotor and the second rotor on which it bears. Finally, as the third part is thicker than the first part and the second part, it is more massive. The third part therefore allows limiting the tangential propagation of the vibratory modes to which the first rotor and the second rotor are subjected. Thus, the damper is capable, thanks to this third part, of dissipating the vibrations by its work in bending and in inertia.

Advantageously, but optionally, the assembly according to the invention may further comprise one of the following characteristics, taken alone or in combination with one or several of the other of the following characteristics:

in such an assembly:

the first part is configured to apply a first centrifugal force on the first rotor, and the second part is configured to apply a second centrifugal force on the second rotor, the first bearing part has a radially outer surface coming into contact with a radially inner surface of the first rotor and the second bearing part has a radially outer surface coming into contact with a radially inner surface of the second rotor, the third radial thickness is greater than each among the first radial thickness and of the second radial thickness, the second radial thickness is greater than the first radial thickness, the bulge comprises a first lip protruding radially inwardly from the damper, the bulge comprises a second lip protruding radially outwardly from the damper, the third part comprises a depression, in such an assembly:

the third part has a first bearing surface arranged to apply a first force on the second rotor, the first force having a first longitudinal component in a first direction parallel to the longitudinal axis, and a first radial component in a second direction orthogonal to the longitudinal axis, the first longitudinal component being greater than the first radial component, the second part has a second bearing surface arranged to apply a second force on the second rotor, the second force having a second longitudinal component in the first direction, and a second radial component in the second direction, the second radial component being greater than the second longitudinal component, each of the blades among the plurality of blades comprises:

a blade root connecting the blade to the disk, a profiled blading, a stilt connecting the blading to the blade root, and a platform connecting the blading to the stilt and extending transversely to the stilt, the first bearing part bearing on each of the platforms of the blades among the plurality of blades, the second rotor comprises a shroud, the shroud comprising a circumferential extension, the second bearing part bearing on the circumferential extension, and the damper is annular, and extends all around the longitudinal axis.

According to a second aspect of the invention, there is proposed a turbomachine comprising an assembly as described above, and in which the first rotor is a fan and the second rotor is a low-pressure compressor.

DESCRIPTION OF THE FIGURES

Other characteristics, aims and advantages of the invention will emerge from the following description, which is purely illustrative and not limiting, and which should be read in relation to the appended drawings in which.

In all of the figures, the similar elements bear identical references.

DETAILED DESCRIPTION OF THE INVENTION

Turbomachine 1

Figure 1:
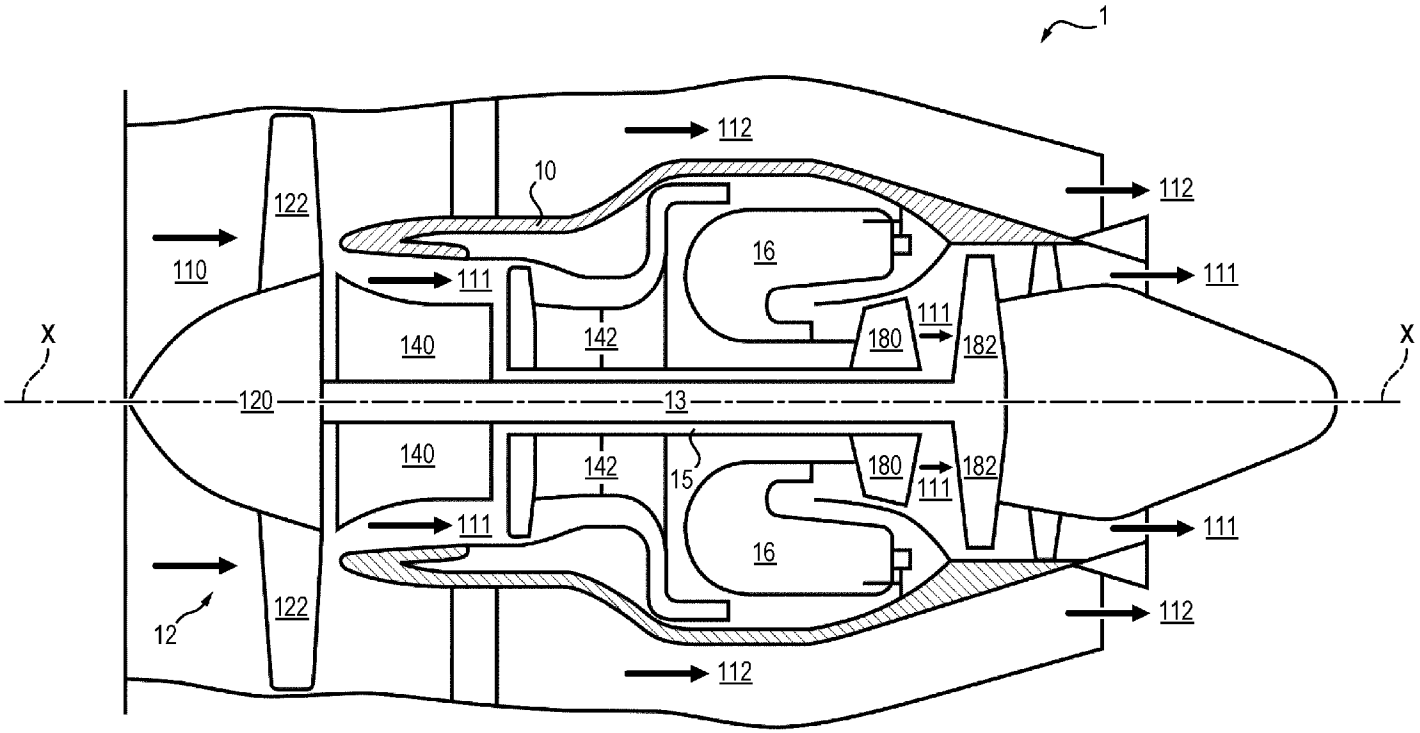
FIG. 1 schematically illustrates a turbomachine.

Referring to FIG. 1, a turbomachine 1 comprises a casing 10, a fan 12, a low-pressure compressor 140, a high-pressure compressor 142, a combustion chamber 16, a high-pressure turbine 180 and a low-pressure turbine 182.

Each of the fan 12, of the low-pressure compressor 140, of the high-pressure compressor 142, of the high-pressure turbine 180 and of the low-pressure turbine 182 is movable in rotation relative to the casing 10 around a longitudinal axis X-X.

Figure 2:
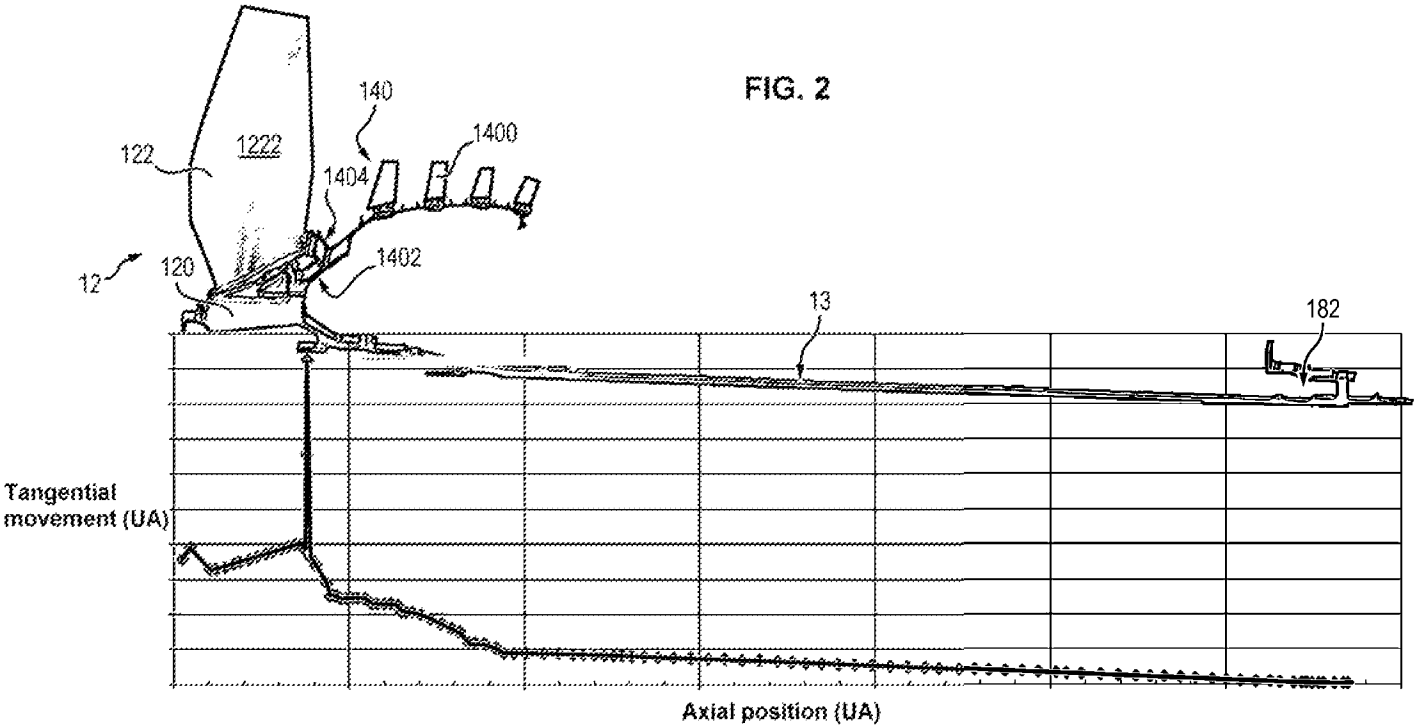
FIG. 2 comprises a sectional view of a part of a turbomachine, and a curve indicating a tangential movement of different elements of this turbomachine part as a function of the position of said elements along a longitudinal axis of the turbomachine.
Figure 3:
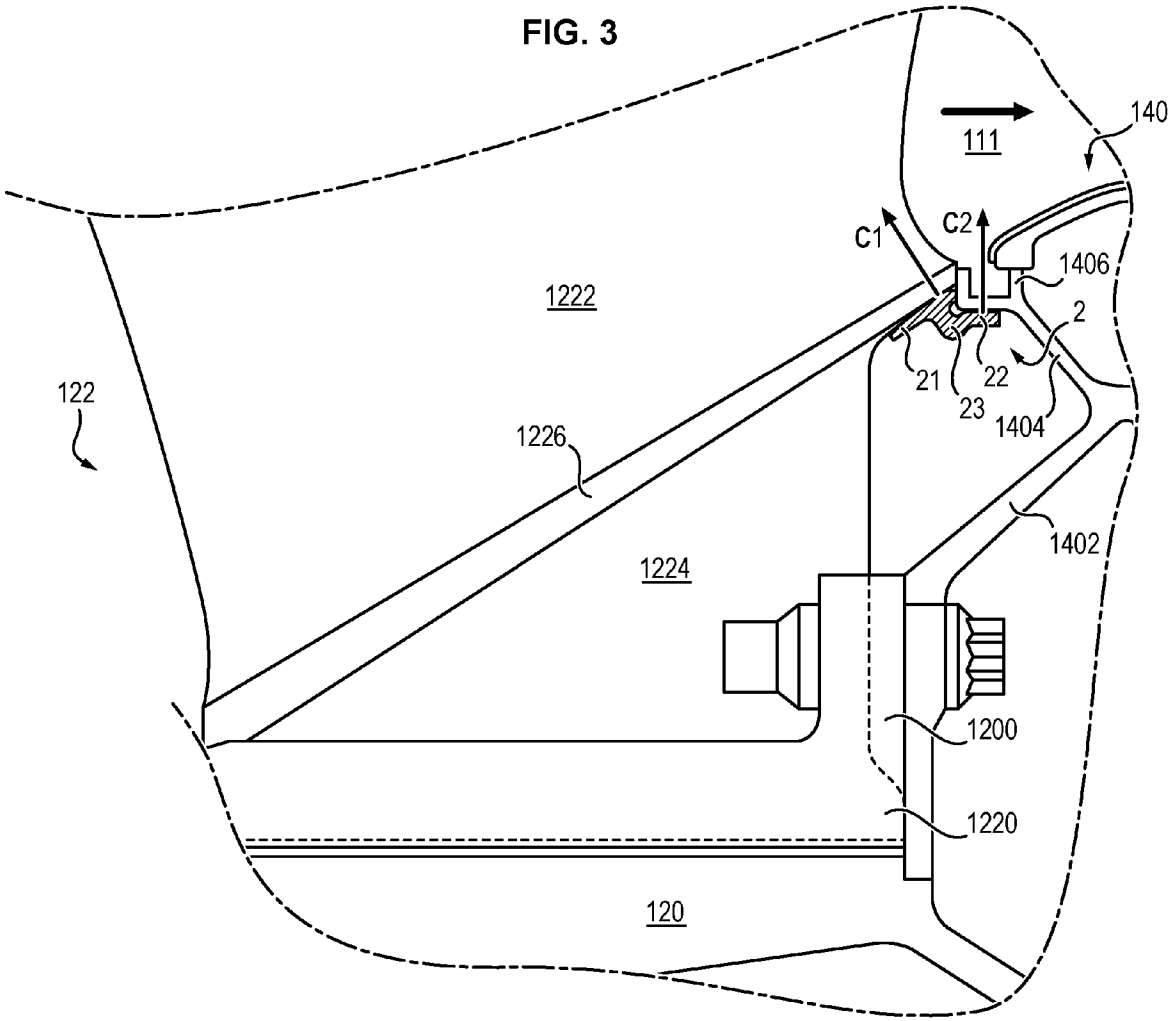
FIG. 3 is a sectional view of part of an exemplary embodiment of an assembly according to the invention.

In the embodiment illustrated in FIG. 1, and as also visible in FIGS. 2 and 3, the fan 12 and the low-pressure compressor 140 are secured in rotation and are capable of being rotated by a low-pressure shaft 13 which is itself capable of being rotated by the low-pressure turbine 182. The high-pressure compressor 142 is for its part capable of being rotated by a high-pressure shaft 15, which is itself capable of being rotated by the high-pressure turbine 180.

In operation, the fan 12 draws in an air stream 110 which separates between a secondary stream 112 circulating around the casing 10, and a primary stream 111 successively compressed within the low-pressure compressor 140 and the high-pressure compressor 142, ignited within the combustion chamber 16, then successively expanded within the high-pressure turbine 180 and the low-pressure turbine 182.

The upstream and the downstream are here defined relative to the direction of normal air flow 110, 111, 112 through the turbomachine 1. Likewise, an axial direction corresponds to the direction of the longitudinal axis X-X, a radial direction is a direction which is perpendicular to this longitudinal axis X-X and which passes through said longitudinal axis X-X, and a circumferential or tangential direction corresponds to the direction of a planar and closed curved line, all the points of which are at equal distance from the longitudinal axis X-X. Finally, and unless otherwise specified, the terms "inner (or internal)" and "outer (or external)", respectively, are used with reference to a radial direction such that the inner (i.e. radially inner) part or face of an element is closer to the longitudinal axis X-X than the outer (i.e. radially outer) part or face of the same element.

Fan 12 and Low-Pressure Compressor 140

Referring to FIGS. 1 to 3, the fan 12 comprises a disk 120 and a plurality of blades 122 circumferentially distributed at an outer part of the disk 120.

Referring to FIGS. 2 and 3, each of the blades 122 of the plurality of blades 122 comprises:

- a blade root 1220 connecting the blade 122 to the disk 120,
- a profiled blading 1222,
- a stilt 1224 connecting the blading 1222 to the blade root 1220, and
- a platform 1226 connecting the blading 1222 to the stilt 1224 and extending transversely to the stilt 1224.

The blade root 1220 may be integral with the disk 120 when the fan 12 is a one-piece bladed disk. Alternatively, as seen in FIG. 3, the blade root 1220 can be configured to be housed in a cell 1200 of the disk 120 provided for this purpose.

As seen in FIGS. 2 and 3, the low-pressure compressor 140 also comprises a plurality of blades 1400 fixedly mounted at an outer part of a shroud 1402, said shroud 1402 comprising a circumferential extension 1404 at the outer end from which radial sealing wipers 1406 extend. The radial sealing wipers 1406 face the platforms 1226 of the blades 122 of the fan 12, so as to guarantee the inner sealing of the flowpath within which the primary stream 111 circulates. As more specifically visible in FIG. 3, the shroud 1402 of the low-pressure compressor 140 is fixed to the disk 120 of the fan 12, for example by bolting.

Each of the blades 122 of the plurality of fan 12 blades 122 is capable of flapping, by vibrating relative to the disk 120 during a rotation of the fan 12 relative to the casing 10. More specifically, during the coupling between the air 110 circulating within the fan 12 and the profiled bladings 1222, the blades 122 are the site of aeroelastic floating phenomena on different vibratory modes, and whose amplitude may be such that it exceeds the endurance limits of the materials constituting the fan 12. These vibratory modes are furthermore coupled to the opposite compressive forces upstream of the turbomachine 1, and to the expansion forces downstream of it.

A first vibratory mode characterizes a synchronous response of the blades 122 to the aerodynamic loads, in which the inter-blade phase-shift is non-zero.

A second vibratory mode characterizes an asynchronous response of the blades 122 to the aerodynamic loads, in which the inter-blade phase-shift is zero. The amplitude of the flapping of the second vibratory mode is moreover as large as the fan 12 blades 122 are large. Furthermore, this second vibratory mode is coupled between the blades 122, the disk 120 and the fan shaft 13. The frequency of the second vibratory mode is in addition one and a half times greater than that of the first vibratory mode. Finally, the second vibratory mode has a nodal deformation at mid-height of the fan 12 blades 122.

In vibratory modes, including the second vibratory mode, the flapping of the blades 122 involves a non-zero moment on the low-pressure shaft 13. In particular, these vibratory modes cause intense torsional forces within the low-pressure shaft 13.

The vibrations induced by the flapping of the blades 122 of the fan 12, but also by the flapping of the blades 1400 of the low-pressure compressor 140, lead to significant relative tangential movements between the fan 12 and the low-pressure compressor 140. Indeed, the length of the blades 122 of the fan 12 is greater than the length of the blades 1400 of the low-pressure compressor 140. Consequently, the tangential bending moment caused by the flapping of a blade 122 of the fan 12 is greater than the tangential bending moment caused by flapping of a blade 1400 of the low-pressure compressor 140. The blading of the blades 122 of the fan 12 and of the blades 1400 of the low-pressure compressor 140 then have very different behaviors. Furthermore, the mounting stiffness within the fan 12 is different from the mounting stiffness within the low-pressure compressor 140.

As seen more specifically in FIG. 2, this results in particular in a large-amplitude movement of the fan 12 relative to the low-pressure compressor 140, in a plane orthogonal to the longitudinal axis X-X, at the interface between the platforms 1226 of the blades 122 of the fan 12 and the radial sealing wipers 1406 of the circumferential extension 1404 of the shroud 1402 of the low-pressure compressor 140. The amplitude of this movement for the second vibratory mode is for example between 0.01 and 0.09 millimeter, typically on the order of 0.06 millimeter, or, in another example, on the order of a few tenths of a millimeter, for example 0.1 or 0.2 or 0.3 millimeter.

Damper 2

A damper 2 is used to damp these vibrations of the fan 12 and/or of the low-pressure compressor 140.

The damper 2 is in particular configured to damp a movement of the fan 12 relative to the low-pressure compressor 140, in a plane orthogonal to the longitudinal axis X-X, the movement being caused by a flapping of at least one blade 122 among the plurality of blades 122 of the fan 12.

Figure 4:
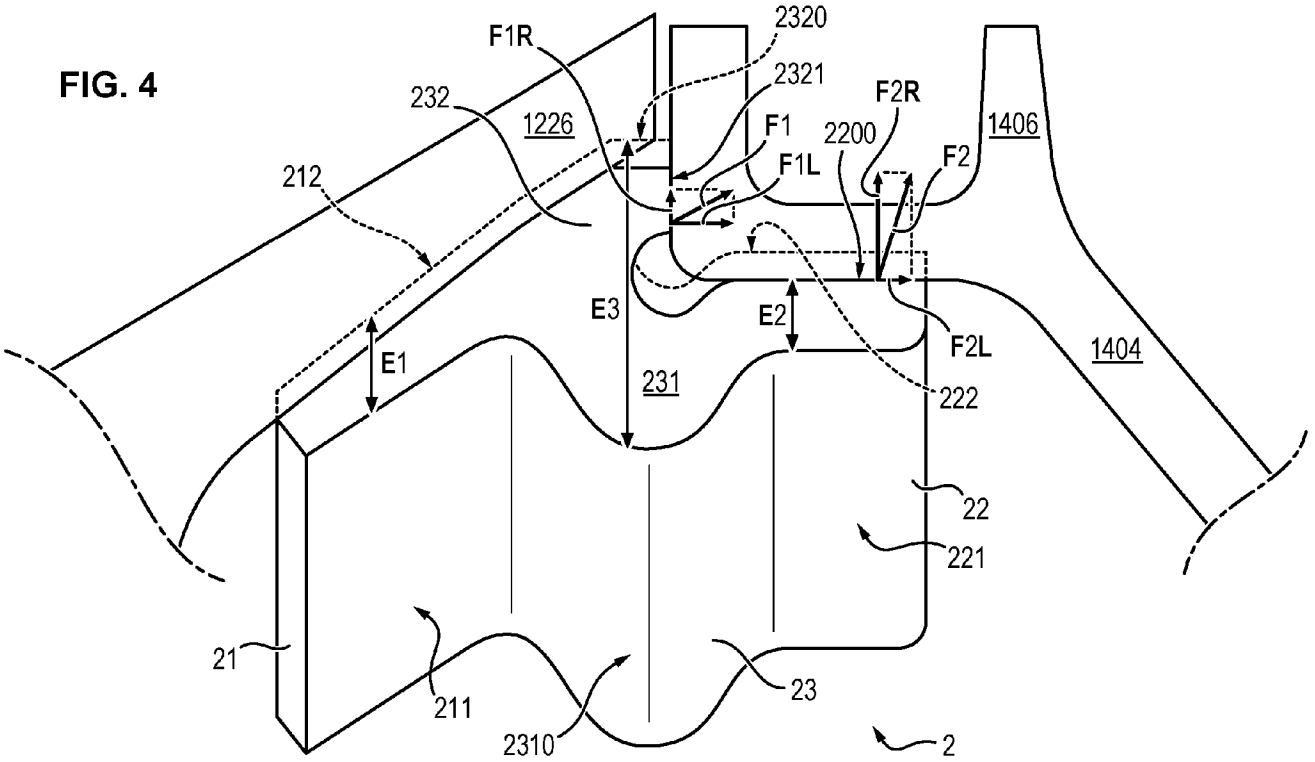
FIG. 4 is a perspective view of part of an exemplary embodiment of an assembly according to the invention.
Figure 5:
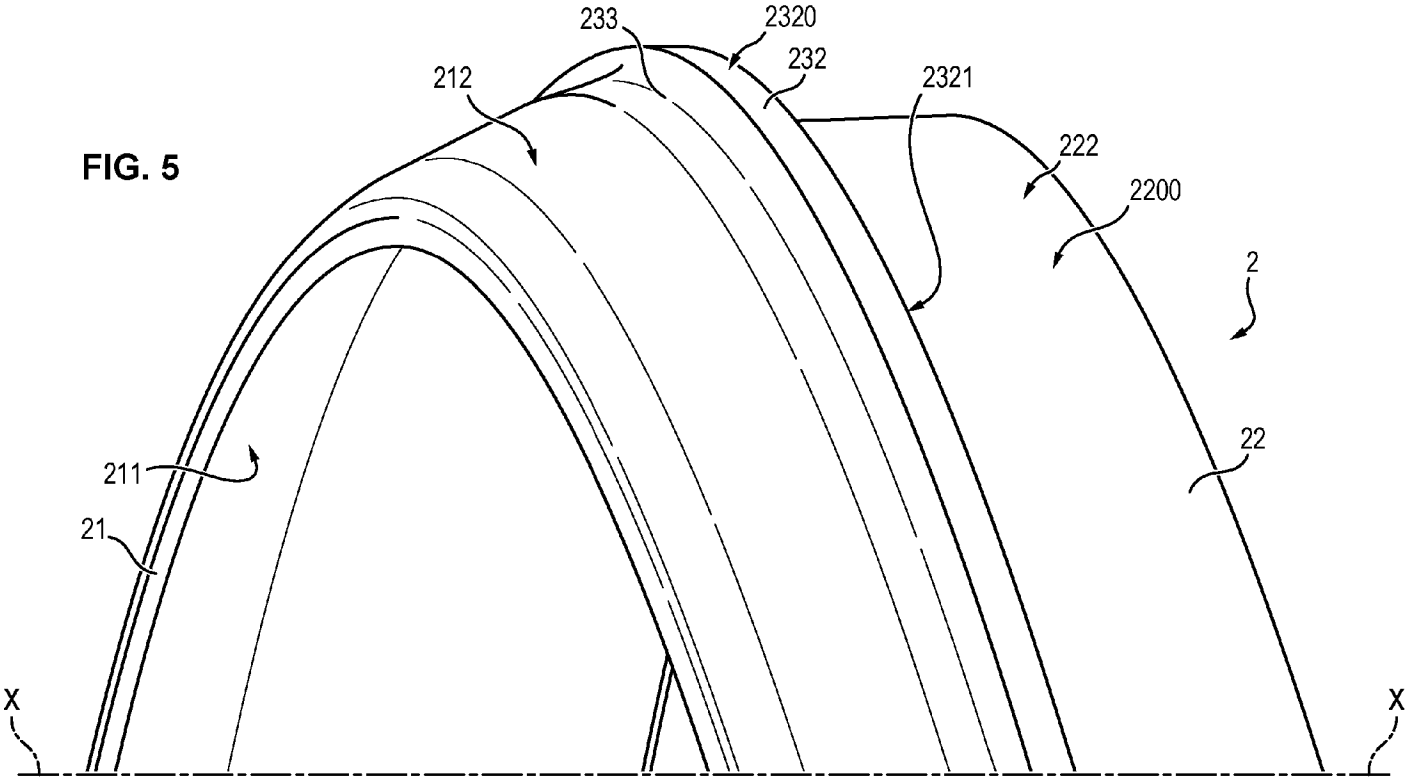
FIG. 5 is a perspective view of a part of a damper of an exemplary embodiment of an assembly according to the invention.

Referring to FIGS. 3 to 5, the damper 2 comprises:

- a first part 21 bearing on the fan 12,
- a second part 22 bearing on the low-pressure compressor 140, and
- a third part 23 connecting the first part 21 to the second part 22.

As in particular seen in FIG. 5, the damper 2 is annular, and therefore extends all around the longitudinal axis X-X. More specifically, the first part 21 has a first radially inner surface 211 extending all around the longitudinal axis X-X, and a first radially outer surface 212 extending all around the first radially inner surface 211. In addition, the second part 22 has a second radially inner surface 221 extending all around the longitudinal axis X-X, and a second radially outer surface 222 extending all around the second radially inner surface 221. Finally, the third part 23 has a third radially inner surface 2310 extending all around the longitudinal axis X-X, and a third radially outer surface 2320 extending all around the third radially inner surface 2310.

In addition, as seen in FIG. 4, the first part 21 has a first radial thickness E1 measured perpendicular to the longitudinal axis X-X between the first radially inner surface 211 and the first radially outer surface 212. Likewise, the second part 22 has a second radial thickness E2 measured perpendicular to the longitudinal axis X-X between the second radially inner surface 221 and the second radially outer surface 222. Finally, the third part 23 has a third radial thickness E3 measured perpendicular to the longitudinal axis X-X between the third radially inner surface 2310 and the third radially outer surface 2320.

The third radial thickness E3 is greater than at least one of the first radial thickness E1 and of the second radial thickness E2. In one embodiment, for example illustrated in FIG. 4, the third radial thickness E3 is greater than each of the first radial thickness E1 and of the second radial thickness E2. In this way, the third part 23 is more massive than the first part 21 and than the second part 22. In an also advantageous variant, the second radial thickness E2 is greater than the first radial thickness E1, so as to promote the bearing of the second part 22 on the low-pressure compressor 140.

In one advantageous embodiment, the first part 21 bears on each of the platforms 1226 of the blades 122 of the fan 12, preferably at an inner surface of each of the platforms 1226. An annular damper 2 is moreover particularly suitable for a fan 12 comprising a disk 120 which is integrally bladed. Indeed, in a fan 12 where the blades 122 are added onto the disk 120, if the damper 2 is annular, then the bearing of the first part 21 on the different platforms 1226 of the blades 122 is not uniform. This induces inhomogeneous damping around the longitudinal axis X-X and, hence, risks of wear of the platforms 1226 and of the damper 2. The inner surfaces of the platforms 1226 may include reliefs so as to be axisymmetric. This circumferential non-symmetry on the internal side of the platforms 1226 can thus optimize the mutual bearings of the damper 2, particularly their distributions, while favoring, where appropriate, bearing wears on these reliefs.

In addition, the second part 22 bears on the circumferential extension 1404 of the shroud 1402 of the low-pressure compressor 140, at an inner surface of the radial sealing wipers 1406. Indeed, it is in this position that the movement of the fan 12 relative to the low-pressure compressor 140, in the plane orthogonal to the longitudinal axis X-X, is of greater amplitude, typically a few millimeters. Consequently, the damper 2 is particularly effective there.

In one embodiment, the damper 2 comprises a material from the range having the trade name "SMACTANE® ST" and/or "SMACTANE® SP", for example a material of the type "SMACTANE® ST 70" and/or "SMACTANE® SP 50". It has indeed been observed that such materials have suitable damping properties.

Referring to FIG. 3, in one embodiment, the first part 21 is configured to apply a first centrifugal force C1 on the fan 12, while the second part 22 is configured to apply a second centrifugal force C2 on the low-pressure compressor 140. To apply the first centrifugal force C1, the first bearing part 21 has a radially outer surface coming into contact with a radially inner surface of the fan 12, typically a radially inner surface of the platform 1226. In order to apply the second centrifugal force C2, the second bearing part 22 has a radially outer surface coming into contact with a radially inner surface of the low-pressure compressor 140, typically a radially inner surface of the circumferential extension 1404, for example a radially inner surface of the sealing wipers 1406. In this way, these parts 21, 22 are each dynamically coupled respectively to the fan 12 and to the low-pressure compressor 140 on which each bears, so as to undergo the same vibrations as each of the fan 12 and of the low-pressure compressor 140.

The third part 23 is stiffer, in particular in a tangential direction. Thus, in operation, a movement of the fan 12 relative to the low-pressure compressor 140, in a plane orthogonal to the longitudinal axis X-X, causes a tangential shear of the damper 2 which leads to circumferential movements of said damper 2. The respective bearings on the fan 12 and the low-pressure compressor 140 are therefore interrupted, then quickly resumed to apply again the centrifugal forces C1, C2. These interruptions and resumptions of the bearings allow the damping. Advantageously, the tangential movements of the high-frequency fan 12 are damped when the parts 21, 22 are bearing against the fan 12 and the low-pressure compressor 140. The interruption of the bearings, then the circumferential sliding, allows damping lower frequencies. In this way, the damper 2 is effective over a wide range of frequencies.

Referring to FIG. 4, in one embodiment, the third part 23 comprises a preferably annular bulge 231, 232. Advantageously, the bulge 231, 232 comprises a first lip 231, itself also annular, and radially protruding inwardly from the damper 2. The first lip 231 is intended to make the third part 23 heavier, which advantageously increases its tangential inertia.

Alternatively or additionally as illustrated in FIG. 4, the bulge 231, 232 comprises a second lip 232, also annular, and radially protruding outwardly from the damper 2. In addition to its function of weighing down the third part 23 which advantageously leads to an increase in the tangential rigidity, the second lip also allows ensuring the axial setting of the damper 2 between the fan 12 and the low-pressure compressor 140.

Referring to FIG. 4, in one embodiment:

the third part 23 has a first bearing surface 2321 arranged to apply a first force F1 on the low-pressure compressor 140, the first force F1 having a first longitudinal component F1L in a first direction parallel to the longitudinal axis X-X, and a first radial component F1R in a second direction orthogonal to the longitudinal axis X-X, the first longitudinal component F1L being greater than the first radial component F1R, the second part 22 has a second bearing surface 2200 arranged to apply a second force F2 on the low-pressure compressor 140, the second force F2 having a second longitudinal component F2L in the first direction, and a second radial component F2R in the second direction, the second radial component F2R being greater than the second longitudinal component F2L.

In other words, the third part 23 ensures the axially positioned bearing of the damper 2, via the first bearing surface 2321, since it is a downstream axial surface of the damper 2 coming into contact with an upstream axial surface of the low-pressure compressor 140.

Furthermore, the second part 22 ensures the radially positioned bearing of the damper 2, via the second bearing surface 2200, since it is a radially outer surface of the damper 2 coming into contact with a radially inner surface of the low-pressure compressor 140. In addition, in operation, the second bearing surface 2200 participates in the application of the second centrifugal force C2 on the low-pressure compressor 140. Advantageously, it is the second lip 232 of the third part 23 which has the first bearing surface 2321, as seen in FIG. 4. Referring to FIGS. 4 and 5, in one embodiment, the third part 23 comprises a depression 233, preferably an annular depression. The depression 233 can be made at an outer surface 2320 or an inner surface 2310 of the third part 23, upstream or downstream of the bulge 231, 232. In the embodiment illustrated in FIG. 5, the depression 233 extends upstream of the bulge. When the depression 233 extends downstream of the bulge 231, 232, as illustrated in FIG. 4, at an outer surface 2320 of the third part 23, it ensures a clearance which allows the damper 2 to avoid to rub on one corner of the radial sealing wipers 1406. In any event, the depression 233 promotes the axial setting of the damper 2 between the fan 12 and the low-pressure compressor 140, but also the sealing of the flowpath of the primary air stream 111. Indeed, under the effect of the first centrifugal force C1, the first part 21 can thus be compressed downstream.

In one embodiment, one at least of the first part 21, the second part 22 and the third part 23 comprises an additional coating configured to reduce the friction and/or the wear of the fan and/or of the low-pressure compressor 140. This additional coating is fixedly mounted on an outer surface of the damper 2, for example by bonding. The additional coating is of the dissipative and/or viscoelastic and/or damping type. It may indeed comprise a material from the range having the trade name "SMACTANE® ST" and/or "SMACTANE® SP", for example a material of the type "SMACTANE® ST 70" and/or "SMACTANE® SP 50". It can also comprise a material chosen from those having mechanical properties similar to those of Vespel, Teflon or any other material with lubricating properties. More generally, the additional coating material advantageously has a coefficient of friction between 0.3 and 0.07. The coating allows in particular increasing the tangential stiffness of the damper 2 when, in operation, it applies the centrifugal forces C1, C2 so that the movement of the fan 12 relative to the low-pressure compressor 140, in the plane orthogonal to the longitudinal axis X-X, is damped by energy dissipation by means of a viscoelastic shear of its coating.

In one embodiment, one at least of the first part 21, the second part 22 and the third part 23 is treated by dry lubrication, with a view to maintaining the value of the coefficient of friction between the damper 2 and either or both of the fan 12 and of the low-pressure compressor 140. This material with lubricating properties is for example of the MoS2 type.

In all that has been described above, the damper 2 is configured to damp a movement of the fan 12 relative to the low-pressure compressor 140, in the plane orthogonal to the longitudinal axis X-X.

This is however not limiting, since the damper 2 is also configured to damp a movement of any first rotor 12 relative to any second rotor 140, in a plane orthogonal to the longitudinal axis X-X, as long as the first rotor 12 is movable in rotation relative to the casing 10 around the longitudinal axis X-X and comprises a disk 120 as well as a plurality of blades 122 capable of flapping by vibrating relative to the disk 120 during a rotation of the first rotor 12 relative to the casing 10, and as the second rotor 140 is also movable in rotation relative to the casing 10 around the longitudinal axis X-X.

Thus, the first rotor 12 can be a first stage of the high-pressure compressor 142 or of the low-pressure compressor 140, and the second rotor 140 can be a second stage of said compressor 140, 142, successive to the first stage of compressor 140, 142, upstream or downstream thereof. Alternatively, the first rotor 12 can be a first stage of a high-pressure turbine 180 or of low-pressure turbine 182, and the second rotor 140 can be a second stage of said turbine 180, 182, successive to the first stage of turbine 180, 182, upstream or downstream thereof.

In any event, the damper 2 has a small space requirement. Consequently, it can be easily integrated into the existing turbomachines.

In addition, by being configured to exert centrifugal forces C1, C2 on the first rotor 12 and on the second rotor 140, the damper 2 ensures significant tangential stiffness between the first rotor 12 and the second rotor 140. It thus differs from an excessively flexible damper which would only deform during a movement of the first rotor 12 relative to the second rotor 140, in the plane orthogonal to the longitudinal axis X-X. On the contrary, the damper 2 dissipates such a movement:

either by friction and/or oscillations between a state where the damper 2 is bonded on the rotors 12, 140 and a state where the damper 2 slides on the rotors 12, 140, which allows damping in particular the low frequencies, or by viscoelastic shear within the damper 2, which allows damping in particular the high frequencies.

However, the damper 2 remains flexible enough to maximize the contact surfaces between said damper 2 and the rotors 12, 140 on which it bears. To do so, the damper 2 has a tangential rigidity greater than an axial rigidity and a radial rigidity.

The contact forces between the damper 2 and the rotors 12, 140 can in particular be adjusted by means of additional coatings. At low frequencies, it is indeed necessary to ensure that the centrifugal forces C1, C2 exerted by the damper 2 on the rotors 12, 140 are not too large, in order to guarantee that the damper 2 can oscillate between a bonded state and a slippery state on the rotors 12, 140, and thus damp by friction. At high frequencies, on the other hand, it is necessary to ensure that the centrifugal forces C1, C2 exerted by the damper 2 on the rotors 12, 140 are sufficiently large for the pre-stress of the damper 2 on the rotors 12, 140 to be sufficient, in order to ensure that the damper 2 can be the viscoelastic shear seat.

The wear of the rotors 12, 140 is in particular limited by the treatment of the surfaces of the damper 2 bearing on the rotors 12, 140, for example to equip them with a coating with a low coefficient of friction.

The invention claimed is:

1. A turbomachine assembly comprising:

a casing;

a first rotor comprising a disk and a plurality of blades, the first rotor being movable in rotation relative to the casing and;

a second rotor movable in rotation relative to the casing around a longitudinal axis; and a damper configured to dampen a movement of the first rotor relative to the second rotor in a plane orthogonal to the longitudinal axis, the movement being caused by a flapping of at least one of the plurality of blades relative to the disk, the damper comprising:

a first part bearing on the first rotor, the first part having a first radially inner surface extending all around the longitudinal axis, a first radially outer surface extending all around the first radially inner surface and a first radial thickness being measured perpendicular to the longitudinal axis between the first radially inner surface and the first radially outer surface;

a second part bearing on the second rotor, the second part having a second radially inner surface extending all around the longitudinal axis, a second radially outer surface extending all around the second radially inner surface and a second radial thickness being measured perpendicular to the longitudinal axis between the second radially inner surface and the second radially outer surface; and a third part connecting the first part to the second part, the third part having a third radially inner surface extending all around the longitudinal axis, a third radially outer surface extending all around the third radially inner surface and a third radial thickness being measured perpendicular to the longitudinal axis between the third radially inner surface and the third radially outer surface, wherein the third radial thickness is greater than at least one of the first radial thickness and the second radial thickness and the third part further comprises a bulge, wherein the third part has a first bearing surface arranged to apply a first force on the second rotor, the first force having a first longitudinal component in a first direction parallel to the longitudinal axis and a first radial component in a second direction orthogonal to the longitudinal axis, the first longitudinal component being greater than the first radial component.

2. The turbomachine assembly of claim 1, wherein the first part is configured to apply a first centrifugal force on the first rotor and the second part is configured to apply a second centrifugal force on the second rotor.

3. The turbomachine assembly of claim 2, wherein the first rotor has a fourth radially inner surface and the second rotor has a fifth radially inner surface, the third radially outer surface coming into contact with the fourth radially inner surface and the second radially outer surface coming into contact with the fifth radially inner surface.

4. The turbomachine assembly of claim 1, wherein the third radial thickness is greater than each of the first radial thickness and of the second radial thickness.

5. The turbomachine assembly of claim 1, wherein the second radial thickness is greater than the first radial thickness.

6. The turbomachine assembly of claim 1, wherein the bulge comprises a first lip protruding radially inwardly from the damper.

7. The turbomachine assembly of claim 1, wherein the bulge comprises a second lip protruding radially outwardly from the damper.

8. The turbomachine assembly of claim 1, wherein the third part comprises a depression.

9. The turbomachine assembly of claim 1, wherein the second part has a second bearing surface arranged to apply a second force on the second rotor, the second force having a second longitudinal component in the first direction and a second radial component in the second direction, the second radial component being greater than the second longitudinal component.

10. The turbomachine assembly of claim 1, wherein each of the plurality of blades comprises:

a blade root connecting the blade to the disk;

a profiled blading;

a stilt connecting the blading to the blade root; and a platform connecting the blading to the stilt and extending transversely to the stilt;

wherein the first part of the damper bears on each platform of the plurality of blades.

11. The turbomachine assembly of claim 1, wherein the second rotor further comprises a shroud, the shroud comprising a circumferential extension, wherein the second part bears on the circumferential extension.

12. The turbomachine assembly of claim 1, wherein the damper is annular and extends all around the longitudinal axis.

13. A turbomachine comprising the turbomachine assembly of claim 1, wherein the first rotor is a fan and the second rotor is a low-pressure compressor.

* * * * *